US011454247B2

(12) United States Patent
MacQueen et al.

(10) Patent No.: US 11,454,247 B2
(45) Date of Patent: Sep. 27, 2022

(54) NOZZLE FOR A FAN ASSEMBLY

(71) Applicant: Dyson Technology Limited, Wiltshire (GB)

(72) Inventors: Neil Ewen Callum MacQueen, Bristol (GB); Philip Tennison Reilly, Oxford (GB); Darren Matthew Lewis, Bristol (GB); James Dyson, Singapore (SG); Alexander Stuart Knox, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 17/254,713

(22) PCT Filed: Jun. 19, 2019

(86) PCT No.: PCT/GB2019/051712
§ 371 (c)(1),
(2) Date: Dec. 21, 2020

(87) PCT Pub. No.: WO2020/002876
PCT Pub. Date: Jan. 2, 2020

(65) Prior Publication Data

US 2021/0270282 A1 Sep. 2, 2021

(30) Foreign Application Priority Data

Jun. 27, 2018 (GB) ..... 1810538

(51) Int. Cl.
*F04D 29/40* (2006.01)
*F04D 29/26* (2006.01)
*F04D 25/08* (2006.01)

(52) U.S. Cl.
CPC ..... *F04D 29/403* (2013.01); *F04D 25/08* (2013.01); *F04D 29/26* (2013.01)

(58) Field of Classification Search
CPC ..... F04D 29/403; F04D 29/26; F04D 25/08; F04D 25/10; F04D 25/12; F04F 5/16
See application file for complete search history.

(56) References Cited

U.S. PATENT DOCUMENTS 2,488,467 A 11/1949 De Lisio
3,823,653 A 7/1974 Roos
(Continued)

FOREIGN PATENT DOCUMENTS

CN 2185861 Y 12/1994
CN 1993243 A 7/2007
(Continued)

OTHER PUBLICATIONS

International Search Report and Written Opinion received for PCT Patent Application No. PCT/GB2019/051713, dated Sep. 25, 2019, 9 pages.
(Continued)

*Primary Examiner* — Syed O Hasan
(74) *Attorney, Agent, or Firm* — Faegre Drinker Biddle & Reath LLP

(57) ABSTRACT

There is provided a nozzle for a fan assembly. The nozzle comprises a nozzle body, an air inlet for receiving an air flow, and one or more air outlets for emitting the air flow. The nozzle body has the general shape of a truncated ellipsoid, with a first truncation forming a face of the nozzle body and a second truncation forming a base of the nozzle body. The one or more air outlets are provided on the face of the nozzle body. Preferably, the air inlet is provided at the base of the nozzle body.

26 Claims, 7 Drawing Sheets

(56) References Cited

U.S. PATENT DOCUMENTS

| | | | | |
|---|---|---|---|---|
| 4,395,201 | A | 7/1983 | Bron | |
| 5,411,371 | A | 5/1995 | Chen | |
| 5,524,827 | A | 6/1996 | Znamensky et al. | |
| 5,821,475 | A | 10/1998 | Morehead et al. | |
| 6,156,085 | A | 12/2000 | Chiu et al. | |
| 8,308,445 | B2 * | 11/2012 | Gammack | F04F 5/46 417/177 |
| 2008/0014855 | A1 | 1/2008 | Leserre | |
| 2010/0014959 | A1 | 1/2010 | Azzouz et al. | |
| 2012/0034108 | A1 | 2/2012 | Wallace et al. | |
| 2012/0051884 | A1 | 3/2012 | Junkel et al. | |
| 2013/0280051 | A1 * | 10/2013 | Nicolas | F01D 25/00 415/182.1 |
| 2014/0255173 | A1 | 9/2014 | Poulton et al. | |
| 2014/0286747 | A1 | 9/2014 | Fang et al. | |
| 2014/0348658 | A1 | 11/2014 | Cunnane | |
| 2016/0121695 | A1 | 5/2016 | Sakurai | |
| 2016/0152116 | A1 | 6/2016 | Albin et al. | |
| 2017/0190240 | A1 | 7/2017 | Paris | |
| 2018/0080676 | A1 | 3/2018 | Cho et al. | |
| 2021/0270283 | A1 | 9/2021 | MacQueen et al. | |
| 2021/0270284 | A1 | 9/2021 | Jukes et al. | |
| 2021/0270292 | A1 | 9/2021 | MacQueen | |
| 2021/0381518 | A1 | 12/2021 | Horton et al. | |

FOREIGN PATENT DOCUMENTS

| | | | |
|---|---|---|---|
| CN | 101649842 | A | 2/2010 |
| CN | 101985949 | A | 3/2011 |
| CN | 102235385 | A | 11/2011 |
| CN | 103133300 | A | 6/2013 |
| CN | 203272264 | U | 11/2013 |
| CN | 103807149 | * | 5/2014 |
| CN | 103807149 | A | 5/2014 |
| CN | 203627312 | U | 6/2014 |
| CN | 203770175 | U | 8/2014 |
| CN | 204084763 | U | 1/2015 |
| CN | 104895768 | A | 9/2015 |
| CN | 105041625 | A | 11/2015 |
| CN | 105508311 | A | 4/2016 |
| CN | 105644302 | A | 6/2016 |
| CN | 106123272 | A | 11/2016 |
| CN | 106286327 | A | 1/2017 |
| CN | 206035913 | U | 3/2017 |
| CN | 106573522 | A | 4/2017 |
| CN | 106884815 | A | 6/2017 |
| CN | 106969482 | A | 7/2017 |
| CN | 207317217 | U | 5/2018 |
| CN | 210829911 | U | 6/2020 |
| CN | 211174828 | U | 8/2020 |
| CN | 211231040 | U | 8/2020 |
| CN | 211343521 | U | 8/2020 |
| CN | 211901107 | U | 11/2020 |
| DE | 10350949 | A1 | 11/2004 |
| DE | 102015001477 | A1 | 12/2015 |
| DE | 102015116242 | B3 | 9/2016 |
| DE | 102016107227 | A1 | 10/2017 |
| EP | 0610866 | A1 | 8/1994 |
| EP | 3321114 | A1 | 5/2018 |
| FR | 2772311 | A1 | 6/1999 |
| FR | 3034175 | A1 | 9/2016 |
| GB | 1347978 | A | 2/1974 |
| GB | 2463698 | A | 3/2010 |
| GB | 2482549 | A | 2/2012 |
| GB | 2493672 | A | 2/2013 |
| GB | 2496464 | A | 5/2013 |
| GB | 2499042 | A | 8/2013 |
| GB | 2502103 | A | 11/2013 |
| JP | S61-195235 | A | 8/1986 |
| JP | S61-195235 | U | 12/1986 |
| JP | 2009-204240 | A | 9/2009 |
| JP | 2012-145308 | A | 8/2012 |
| JP | 2014-088774 | A | 5/2014 |
| JP | 2014-234936 | A | 12/2014 |
| JP | 5663051 | B2 | 2/2015 |
| JP | 2015-175309 | A | 10/2015 |
| KR | 10-0225915 | B1 | 7/1999 |
| KR | 10-1601325 | B1 | 3/2016 |
| KR | 10-1647382 | B1 | 8/2016 |
| KR | 10-1735432 | B1 | 5/2017 |
| TW | 336963 | | 8/1999 |
| WO | 99/07569 | A1 | 2/1999 |
| WO | 2010/100451 | A1 | 9/2010 |
| WO | 2013/035271 | A1 | 3/2013 |
| WO | 2014/075399 | A1 | 5/2014 |
| WO | 2017/050754 | A1 | 3/2017 |
| WO | 2020/089581 | A1 | 5/2020 |

OTHER PUBLICATIONS

International Search Report and Written Opinion received for PCT Patent Application No. PCT/GB2019/051714, dated Sep. 24, 2019, 9 pages.

International Search Report and Written Opinion received for PCT Patent Application No. PCT/GB2019/051715, dated Oct. 2, 2019, 8 pages.

Office Action received for Chinese Patent Application No. 201910559580.0, dated Jul. 2, 2021, 22 pages (14 pages of English Translation and 8 pages of Original Document).

Office Action received for Chinese Patent Application No. 201910566663.2, dated Jul. 2, 2021, 25 pages (15 pages of English Translation and 10 pages of Original Document).

Search Report dated Dec. 10, 2018, directed to GB Application No. 1810539.5; 1 page.

Search Report dated Dec. 19, 2018, directed to GB Application No. 1810540.3; 1 page.

Search Report dated Dec. 19, 2018, directed to GB Application No. 1810541.1; 1 page.

The First Office Action dated Dec. 7, 2020, directed to CN Application No. 201910559831.5; 18 pages.

The First Office Action dated Oct. 12, 2020, directed to CN Application No. 201910566663.2; 13 pages.

International Search Report and Written Opinion dated Sep. 24, 2019, directed to International Application No. PCT/GB2019/051712; 12 pages.

Office Action dated Oct. 12, 2020, directed to CN Application No. 201910559596.1; 16 pages.

Search Report dated Dec. 10, 2018, directed to GB Application No. 1810538.7; 1 page.

Evaluation Report dated Nov. 16, 2020, directed to CN Application No. ZL2019218644124; 13 pages.

International Search Report and Written Opinion dated Dec. 17, 2019, directed to International Application No. PCT/GB2019/052834; 11 pages.

Search Report dated Apr. 30, 2019, directed to GB Application No. 1817852.5; 1 page.

The First Office Action dated May 6, 2021, directed to CN Application No. 201911050925.6; 15 pages.

Singapore Search Report and Written Opinion Received for SG Application No. 11202009931S, dated May 20, 2022, 8 pages.

Office Action received for Patent Application No. KR 10-2021-7000200, dated May 20, 2022, 13 pages (7 pages of English Translation and 6 pages of Original Document).

Office Action received for Patent Application No. KR 10-2021-7000470, dated May 20, 2022, 11 pages (6 pages of English Translation and 5 pages of Original Document).

* cited by examiner

NOZZLE FOR A FAN ASSEMBLY

REFERENCE TO RELATED APPLICATIONS

This application is a national phase application under 35 USC 371 of International Application No. PCT/GB2019/051712, filed Jun. 19, 2019, which claims the priority of United Kingdom Application No. 1810538.7, filed Jun. 27, 2018, the entire contents of each of which are incorporated herein by reference.

FIELD OF THE DISCLOSURE

The present invention relates to a nozzle for a fan assembly, and a fan assembly comprising such a nozzle.

BACKGROUND OF THE DISCLOSURE

A conventional domestic fan typically includes a set of blades or vanes mounted for rotation about an axis, and drive apparatus for rotating the set of blades to generate an airflow. The movement and circulation of the airflow creates a 'wind chill' or breeze and, as a result, the user experiences a cooling effect as heat is dissipated through convection and evaporation. The blades are generally located within a cage which allows an airflow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an airflow into the base, and a series of concentric, annular nozzles connected to the base and each comprising an annular outlet located at the front of the nozzle for emitting the airflow from the fan. Each nozzle extends about a bore axis to define a bore about which the nozzle extends.

Each nozzle is in the shape of an airfoil may therefore be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the airflow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary airflow into the base, and a single annular nozzle connected to the base and comprising an annular mouth/outlet through which the primary airflow is emitted from the fan. The nozzle defines an opening through which air in the local environment of the fan assembly is drawn by the primary airflow emitted from the mouth, amplifying the primary airflow. The nozzle includes a Coanda surface over which the mouth is arranged to direct the primary airflow. The Coanda surface extends symmetrically about the central axis of the opening so that the airflow generated by the fan assembly is in the form of an annular jet having a cylindrical or frusto-conical profile.

The user is able to change the direction in which the air flow is emitted from the nozzle in one of two ways. The base includes an oscillation mechanism which can be actuated to cause the nozzle and part of the base to oscillate about a vertical axis passing through the centre of the base so that that air flow generated by the fan assembly is swept about an arc of around 180 degrees. The base also includes a tilting mechanism to allow the nozzle and an upper part of the base to be tilted relative to a lower part of the base by an angle of up to 10 degrees to the horizontal.

SUMMARY OF THE DISCLOSURE

According a first aspect there is provided a nozzle for a fan assembly. The nozzle comprises a nozzle body having the general shape of a truncated ellipsoid, with a first truncation defining a face of the nozzle body and a second truncation defining a base of the nozzle body, an air inlet for receiving an air flow, the air inlet being provided at the base of the nozzle body, and one or more air outlets for emitting the air flow, the one or more air outlets being provided at the face of the nozzle body. The nozzle body defines an opening at the face of the nozzle body, and the nozzle further comprises an intermediate surface disposed within the opening, with the one or more air outlets being disposed around a periphery of the intermediate surface.

The nozzle body or outer casing defines one or more outermost surfaces of the nozzle. The nozzle body or outer casing therefore substantially defines the external shape or form of the nozzle. The face of the nozzle may therefore comprise the intermediate surface and a portion of the nozzle body (i.e. the edge of the opening) that extends around or surrounds the periphery of the intermediate surface. Preferably, base of the nozzle body is arranged to be mounted over an air outlet of the fan assembly such that an air flow emitted from the fan assembly is received by the air inlet of the nozzle. The nozzle body may define a further opening at the base of the nozzle body, with air inlet of the nozzle being provided within the further opening.

This nozzle geometry provides a number of advantages over conventional nozzles. In particular, the ellipsoidal shape of the nozzle body provides that nozzle body substantially conforms to each of an annular outlet from the fan body, a generally elliptical overall outlet provided on the face of the nozzle and a curved internal air passageway that extends from the air inlet of the nozzle to the overall outlet. This shape therefore optimizes the space consumed by the nozzle body, whilst also optimizing the flow path of the airflow between the air inlet of the nozzle and the overall air outlet so as to improve the overall efficiency with which the air flow is directed by the nozzle. In this regard, the air vent/opening through which an airflow is exhausted from a motor-driven impeller is typically annular in shape. The ellipsoidal shape of the nozzle body therefore provides that shape of the nozzle body at the air inlet of the nozzle substantially conforms to that of an annular or approximately annular air inlet. In addition, the ellipsoidal shape of the nozzle body provides the nozzle with a larger inlet end so that the corresponding outlet from the fan body that will contain the motor-driven impeller can be larger, providing improved airflow, pressure and efficiency. Furthermore, providing the nozzle with a generally elliptical overall air outlet provides advantages with respect to the efficiency and flexibility with which an air flow can be emitted from the nozzle. The ellipsoidal shape of the nozzle body therefore provides that shape of the nozzle body at the overall air outlet of the nozzle substantially conforms to that of an elliptical air outlet.

The nozzle may further comprise a single internal air passageway within the nozzle body that extends between the air inlet and the one or more air outlets. Preferably, the air inlet is at least partially defined by a first end of the air passageway and the one or more air outlets are at least partially defined by an opposite, second end of the air passageway. The first end of the air passageway may be disposed within the further opening at the base of the nozzle body. The second end of the air passageway may be disposed within the opening at the face of the nozzle body. The air passageway may be at least partially defined by an internal surface of the nozzle. Preferably, the internal surface of the nozzle that defines the internal air passageway is curved.

The air passageway may have a generally elliptical cross-section (i.e. in a plane that is parallel to either the face or base of the nozzle body). Preferably, the cross-sectional area of the air passageway varies between the air inlet and the one or more air outlets. More preferably, the air passageway widens adjacent the air inlet and narrows adjacent the one or more air outlets. The cross-sectional area of the air passageway is then at a maximum between the air inlet and the one or more air outlets.

The air passageway may comprise a plenum region between the air inlet and the one or more air outlets. The plenum region may be defined by an internal surface of the nozzle and a diverting surface disposed within the nozzle body, wherein the diverting surface is arranged to direct the airflow within the air passageway towards the one or more air outlets.

Using a single internal passageway to convey an air flow from a generally annular air inlet to an elliptical air outlet also provides improved efficiency and flexibility, particularly if this passageway is shaped so as to provide a smooth transition for the air flow as it travels from the air inlet to the air outlet of the nozzle. The ellipsoidal shape of the nozzle body then further provides that the shape of the nozzle body will generally conform to that of the internal passageway whilst also providing space for additional components of the nozzle.

An angle of the face of the nozzle body relative to the base of the nozzle body may be fixed. Preferably, the angle of the face relative to the base is from 0 to 90 degrees, is more preferably from 0 to 45 degrees, and is yet more preferably from 20 to 35 degrees.

The intermediate surface may span an area between the one or more air outlets. In other words, the intermediate surface may extend across an area that is bounded by the one or more the air outlets. Preferably, the intermediate surface can be located concentrically within the face of the nozzle body. The intermediate surface may be flat or partially convex. Preferably, the intermediate surface defines a portion of each of the one or more air outlets. The one or more air outlets may then each be defined by a portion of the intermediate surface and an opposing portion of the nozzle body. For each of the one or more air outlets, the portion of the intermediate surface that partially defines the air outlet may have a shape that corresponds with a shape of the opposing portion of the nozzle body. In particular, the portion of the intermediate surface that partially defines the air outlet may have a radius of curvature that is substantially equal to a radius of curvature of the opposing portion of the nozzle body.

The one or more air outlets may be oriented to direct an air flow over at least a portion of the intermediate surface. The one or more air outlets may be arranged to direct the air flow emitted therefrom such that the air flow passes across at least a portion of the intermediate surface. The one or more air outlets may be arranged to direct an air flow over a portion of the intermediate surface that is adjacent to the respective air outlet.

The nozzle may define a generally elliptical gap/opening between the intermediate surface and the nozzle body and the one or more air outlets may then be provided by portions of the gap/opening. In particular, the gap/opening may be defined by an edge of the opening at the face of the nozzle body and an opposing portion of the intermediate surface.

The one or more air outlets may be oriented towards a convergent point. The convergent point may be located on a central axis of the face of the nozzle body.

The one or more air outlets may each comprise a curved slot that is provided on the face of the nozzle body. The curved slots may be arcuate. Preferably, the one or more air outlets are shaped as congruent arcs, and are more preferably shaped as congruent circular arcs.

The nozzle may comprise a first air outlet and a second air outlet. The first and second air outlets are discrete. In other words, the first air outlet and the second air outlet are physically separated from one another. Preferably, the first and second air outlets comprise a pair of curved slots that are diametrically opposed on the face of the nozzle body. The first and second air outlets may comprise a pair of arcuate slots having an arc angle of from 20 to 110 degrees, preferably from 45 to 90 degrees, and more preferably from 60 to 80 degrees. The pair of curved slots may be provided by separate portions of the gap/opening. An outer or inner perimeter of the opening is from 3 to 18 times greater than the outer or inner perimeter of each of the first and second air outlets, is preferably from 4 to 8 times greater, and more preferably from 4 to 6 times greater.

The portions of the gap/opening between the pair of curved slots may be each occluded by one or more covers. The one or more covers may be moveable between a closed position in which the portions of the opening between the pair of curved slots are occluded and an open position in which the portions of the opening between the pair of curved slots are open. Alternatively, the one or more covers may be fixed, and are then preferably integral with one or more of the nozzle body and the intermediate surface of the nozzle. For each of the portions of the gap/opening between the pair of curved slots, the corresponding cover may have a shape that corresponds with a shape of the opposing portion of the nozzle body. In particular, the corresponding cover may have a radius of curvature that is substantially equal to a radius of curvature of the opposing portion of the nozzle body.

The nozzle may further comprise a valve for controlling an air flow from the air inlet to the one or more air outlets. The first and second air outlets may together define a combined/aggregate air outlet, and the valve may then comprise one or more valve members which are moveable to adjust the size (i.e. the open area) of the first air outlet relative to the size of the second air outlet while keeping the size of the combined/aggregate air outlet constant. For each of the valve members, the valve member may have a shape that corresponds with a shape of an opposing portion of the nozzle body. In particular, the valve member may have a radius of curvature that is substantially equal to a radius of curvature of the opposing portion of the nozzle body. The one or more valve members may be arranged to move translationally (i.e. without rotation), and preferably rectilinearly (i.e. in a straight line). The one or more valve members may be arranged to move laterally relative to a body of the nozzle, and optionally may also be arranged to move laterally relative to the external guide surface.

A maximum diameter of the nozzle body may be from 1.05 to 2 times greater than the diameter of the circular base of the nozzle body, and is preferably from 1.1 to 1.4 times greater. A maximum diameter of the nozzle body may be from 1.05 to 2 times greater than a diameter of the circular face of the nozzle body, and is preferably from 1.1 to 1.4 times greater.

The nozzle body may have the general shape of a truncated sphere, with a first truncation forming a circular face of the nozzle and a second truncation forming at least part of a circular base of the nozzle body.

According to a second aspect there is provided a nozzle for a fan assembly. The nozzle comprises a nozzle body, an air inlet for receiving an air flow, and one or more air outlets for emitting the air flow. The nozzle body has the general shape of a truncated ellipsoid, with a first truncation forming a face of the nozzle body and a second truncation forming a base of the nozzle body. The one or more air outlets are provided on the face of the nozzle body. Preferably, the air inlet is provided at the base of the nozzle body.

According a third aspect there is provided assembly comprising an impeller, a motor for rotating the impeller to generate an air flow, and a nozzle according to any of the first aspect and the second aspect for receiving the air flow. The fan assembly may comprise a base upon which the fan assembly is supported, and an angle of the face of the nozzle relative to the base of the fan assembly is then preferably fixed. Preferably, the angle of the face of the nozzle relative to the base of the fan assembly is from 0 to 90 degrees, is more preferably from 0 to 45 degrees, and is yet more preferably from 20 to 35 degrees. The base of the fan assembly is preferably provided at a first end of a body of the fan assembly, and the nozzle is then preferably mounted to an opposite second end of the body of the fan assembly. Preferably, the motor and the impeller are housed within the body of the fan assembly.

BRIEF DESCRIPTION OF THE FIGURES

An embodiment of the present invention will now be described, by way of example only, with reference to the accompanying drawings, in which.

DETAILED DESCRIPTION OF THE DISCLOSURE

Figure 1:
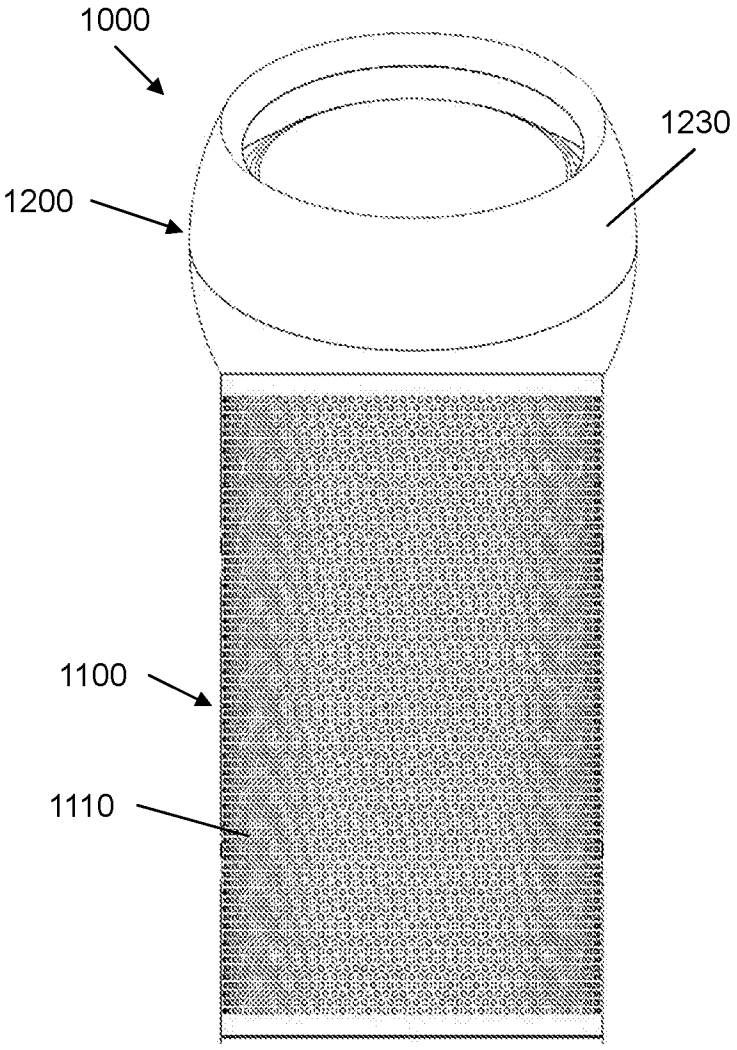
FIG. 1 is a front view of a first embodiment of a fan assembly.

There will now be described a nozzle for a fan assembly that has the general shape of a truncated ellipsoid, with this geometry providing a number of advantages over conventional nozzles. The term "fan assembly" as used herein refers to a fan assembly configured to generate and deliver an airflow for the purposes of thermal comfort and/or environmental or climate control. Such a fan assembly may be capable of generating one or more of a dehumidified airflow, a humidified airflow, a purified airflow, a filtered airflow, a cooled airflow, and a heated airflow.

The nozzle comprises a nozzle body or outer casing having the general shape of a truncated ellipsoid, with a first truncation defining a face of the nozzle body and a second truncation defining a base of the nozzle body, an air inlet for receiving an air flow, the air inlet being provided at the base of the nozzle body, and one or more air outlets for emitting the air flow, the one or more air outlets being provided at the face of the nozzle body. The nozzle body defines an opening at the face of the nozzle body, and the nozzle further comprises an intermediate surface disposed within the opening, with the one or more air outlets being disposed around a periphery of the intermediate surface. The truncated ellipsoidal shape of the nozzle body/outer casing provides that both the face and base of the nozzle body/outer casing will be generally elliptical in shape. Preferably, an angle of the face of the nozzle body/outer casing relative to the base of the nozzle body is fixed, with this angle being from 0 to 90 degrees.

The nozzle body or outer casing defines one or more outermost surface of the nozzle. The nozzle body or outer casing therefore substantially defines the external shape or form of the nozzle. The face of the nozzle may therefore comprise the intermediate surface and a portion of the nozzle body (i.e. the edge of the opening) that extends around or surrounds the periphery of the intermediate surface. The intermediate surface is then outward facing, i.e. faces away from the centre of the nozzle, and is exposed within the opening at the face of the nozzle body. The intermediate surface may therefore extend at least partially across the face the nozzle. Preferably, base of the nozzle body is arranged to be mounted over an air outlet of the fan assembly such that an air flow emitted from the fan assembly is received by the air inlet of the nozzle. The nozzle body may define a further opening at the base of the nozzle body, with air inlet of the nozzle being provided within the further opening.

The term "ellipsoid" as used herein refers to a three-dimensional geometric shape for which all planar sections of the shape are ellipses or circles. An ellipsoid therefore has three independent axes, and is usually specified by the lengths of the three semi-axes. An ellipsoid with two semi-axes of equal length is called an ellipsoid of revolution, or spheroid. An ellipsoid for which all three semi-axes are of equal length is called a sphere.

The term "air outlet" as used herein refers to a portion of the nozzle through which an air flow escapes from the nozzle. In particular, in the embodiments described herein, each air outlet comprises a conduit or duct that is defined by the nozzle and through which an air flow exits the nozzle. Each air outlet could therefore alternatively be referred to as an exhaust. This contrasts with other portions of the nozzle that are upstream from the air outlets and that serve to channel an air flow between an air inlet of the nozzle and an air outlet.

It is preferable that the nozzle comprises a single internal air passageway or duct extending between the air inlet and the one or more air outlets. The air inlet may then be at least partially defined by a first end of the air passageway and the one or more air outlets at least partially defined by an opposite, second end of the air passageway. Preferably, the air passageway is shaped so that it approximately conforms to the shape of the nozzle body. The air passageway may therefore have a generally elliptical cross-section, with the cross-sectional area of the air passageway in a plane that is parallel to either the face or base of the nozzle body varying between the air inlet and the one or more air outlets. Consequently, it is preferable that one or both of the first end of the air passageway and the second end of the air passageway have a generally elliptical cross-section.

Preferably, the air passageway widens or flares outwardly adjacent the air inlet and narrows adjacent the one or more air outlets. In other words, it is preferable that the cross-sectional area of the air passageway increases as the air passageway extends from the air inlet until it reaches a maximum between the air inlet and the one or more air outlets before decreasing as the internal air passageway approaches the one or more air outlets. Preferably, the surface of the air passageway is entirely curved so as to provide a smooth transition for the air flow as it travels from the air inlet to the one or more air outlets. The term "curved" as used herein refers to a surface that gradually deviates from planarity in a smooth, continuous fashion.

The air passageway may be at least partially defined by an internal surface of the nozzle. This internal surface may be provided by an internal wall of the nozzle, wherein the internal wall is disposed within the nozzle body.

Figure 2:
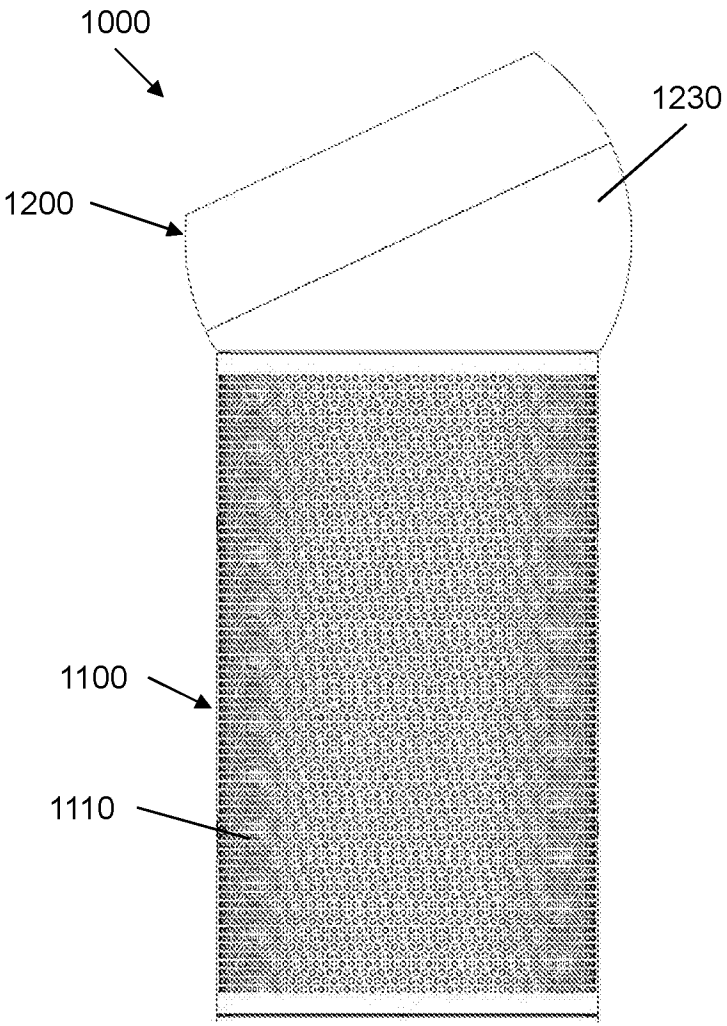
FIG. 2 is a side view of the fan assembly of FIG. 1.
Figure 4:
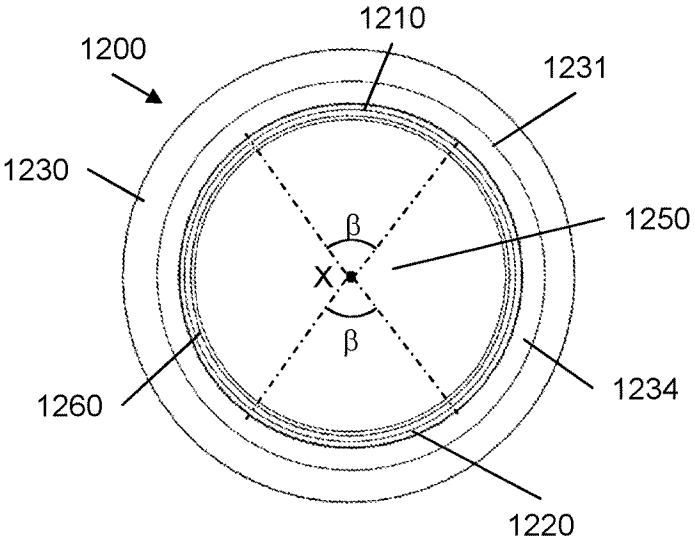
FIG. 4 is a top view of the spherical nozzle of the fan assembly of FIGS. 1 and 2.
Figure 3:
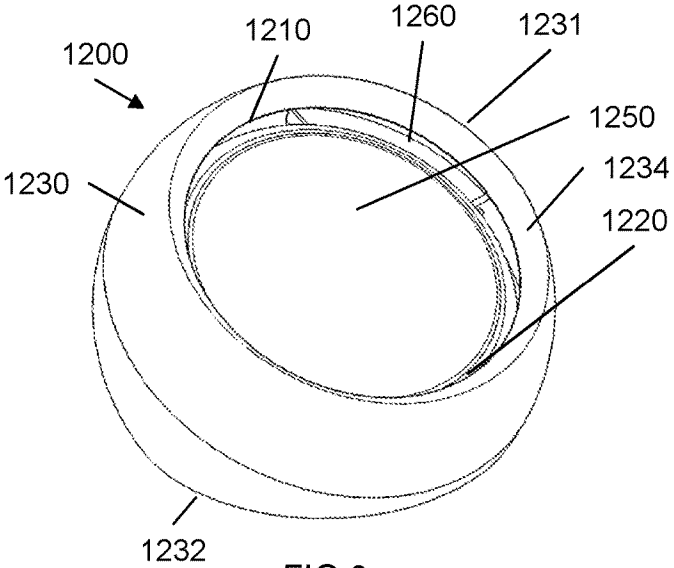
FIG. 3 is a perspective view of the spherical nozzle of the fan assembly of FIGS. 1 and 2.
Figure 6:
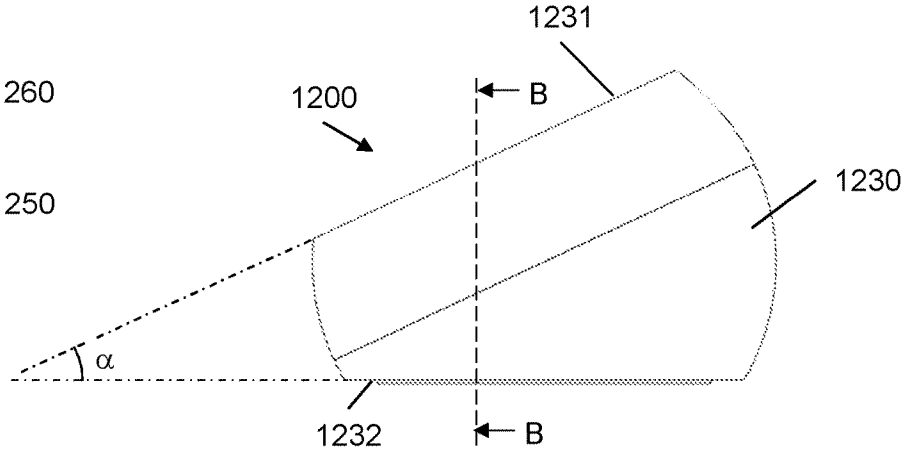
FIG. 6 is a side view of the spherical nozzle of the fan assembly of FIGS. 1 and 2.
Figure 5:
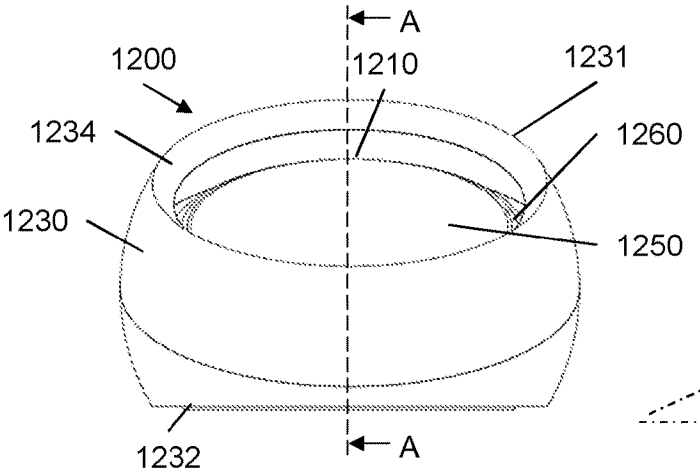
FIG. 5 is a front view of the spherical nozzle of the fan assembly of FIGS. 1 and 2.

FIGS. 1 and 2 are external views of a first embodiment of a fan assembly 1000. FIG. 1 shows a front view of the fan assembly 1000 and FIG. 2 is a side view of the fan assembly 1000. FIG. 3 shows a perspective view of the nozzle 1200 of the fan assembly 1000 of FIGS. 1 and 2. FIGS. 4, 5 and 6 then show top, front and side views of the nozzle 2200 respectively.

The fan assembly 1000 comprises a body or stand 1100 and a generally spherical nozzle 1200 mounted on the body 1100. As will be described in more detail below, the body or outer casing 1230 of the nozzle 1200 has the general shape of a truncated sphere, with a first truncation forming a circular face 1231 of the nozzle body 1230 and a second truncation forming a circular base 1232 of the nozzle body 1230, and with the angle (a) of the face 1231 relative to the base 1232 being fixed at approximately 25 degrees. However, the angle of the face 1231 relative to the base 1232 of the nozzle body 1230 could be anything from 0 to 90 degrees, is more preferably from 0 to 45 degrees, and is yet more preferably from 20 to 35 degrees. The nozzle 1200 then has a single internal air passageway 1270 that extends from a circular opening provided at the base 1232 of the nozzle 1200 that partially defines the air inlet 1240 of the nozzle 1200 to a generally annular opening 1260 at the face 1231 of the nozzle 1200 that partially defines the air outlets of the nozzle 1200.

In this embodiment, the body 1100 is substantially cylindrical and comprises an air inlet 1110 through which an air flow enters the body 1100 of the fan assembly 1000, and the air inlet 1110 comprises an array of apertures formed in the body 1100. Alternatively, the air inlet 1110 may comprise one or more grilles or meshes mounted within windows formed in the body 1100. The body 1100 houses a motor-driven impeller (not shown) for drawing an airflow through the air inlet 1110 and into the body 1100. Preferably, the body 1100 further comprises at least one purifying/filter assembly (not shown) that comprises at least one particulate filter media. The at least one purifying/filter assembly is then preferably located downstream of the air inlet 1110 but upstream of the motor-driven impeller, such that the air drawn into the body 1100 by the impeller is filtered prior to passing through the impeller. This serves to remove any particles which could potentially cause damage to the fan assembly 1000, and also ensures that the air emitted from the nozzle 1200 is free from particulates. In addition, the purifying/filter assembly preferably further comprises at least one chemical filter media that serves to remove various chemical substances from the air flow that could potentially be a health hazard so that the air emitted from the nozzle 1200 is purified.

In the illustrated embodiment, the nozzle 1200 is mounted on the upper end of the body 1100 over an annular air vent through which the airflow exits the body 1100 of the fan assembly. The nozzle 1200 has an open lower end which provides the air inlet 1240 for receiving the airflow from the body 1100. The external surface of an outer wall of the nozzle 1200 then converges with the outer edge of the body 1100.

The body or outer casing 1230 of the nozzle 1200 defines the outermost surfaces of the nozzle and therefore defines the external shape or form of the nozzle 1200. As described above, the body/outer casing 1230 has the general shape of a truncated sphere such that the nozzle 1200 as a whole has the general shape of a truncated sphere. In the illustrated embodiment, the first truncation provides that the diameter ($D_N$) of the nozzle body 1230 is approximately 1.2 times greater than the diameter ($D_F$) of the circular face 1231 of the nozzle body 1230; however, the diameter ($D_N$) of the nozzle body 1230 could be anything from 1.05 to 2 times greater than a diameter ($D_F$) of the circular face 1231 of the nozzle body, and is preferably from 1.1 to 1.4 times greater. The second truncation then provides that diameter ($D_N$) of the nozzle body 1230 is also approximately 1.2 times greater than the diameter ($D_B$) of the circular base 1232 of the nozzle body 1230; however, the diameter ($D_N$) of the nozzle body 1230 could be anything from 1.05 to 2 times greater than the diameter ($D_B$) of the circular base 1232 of the nozzle body 1230, and is preferably from 1.1 to 1.4 times greater.

The nozzle body 1230 defines an opening at the circular face 1231 of the nozzle body 1230. The nozzle 1200 then further comprises a fixed, external guide surface 1250 that can be located concentrically within the opening at the circular face 1231 of the nozzle body 1230 such that this external guide surface 1250 is at least partially exposed within the opening, with a portion of the nozzle body 1230 extending around the periphery of the guide surface 1250. The external guide surface 1250 is therefore outward facing (i.e. faces away from the centre of the nozzle).

In the illustrated embodiment, this guide surface 1250 is convex and substantially disk-shaped; however, in alternative embodiments the guide surface 1250 could be flat or only partially convex. An inwardly curved upper portion 1230*a* of the nozzle body 1230 then overlaps/overhangs a circumferential portion 1250*a* of the guide surface 1250. The outermost, central portion 1250*b* of the convex guide surface is then offset relative to the outermost point of the open circular face 1231 of the nozzle body 1230. In particular, the outermost point of the open circular face 1231 of the nozzle body 1230 is in front of the outermost portion 1250*b* of the guide surface.

The circumferential portion 1250*a* of the guide surface 1250 and an opposing portion of the nozzle body 1230 together define a generally annular gap 1260 between them, with this gap 1260 providing a single overall air outlet of the nozzle 1200. The guide surface 1250 therefore provides an intermediate surface that spans the area that is surrounded/bounded by the overall air outlet of the nozzle 1200 (i.e. the overall air outlet of the nozzle 1200 is disposed around the periphery/perimeter of this intermediate surface).

Figure 7:
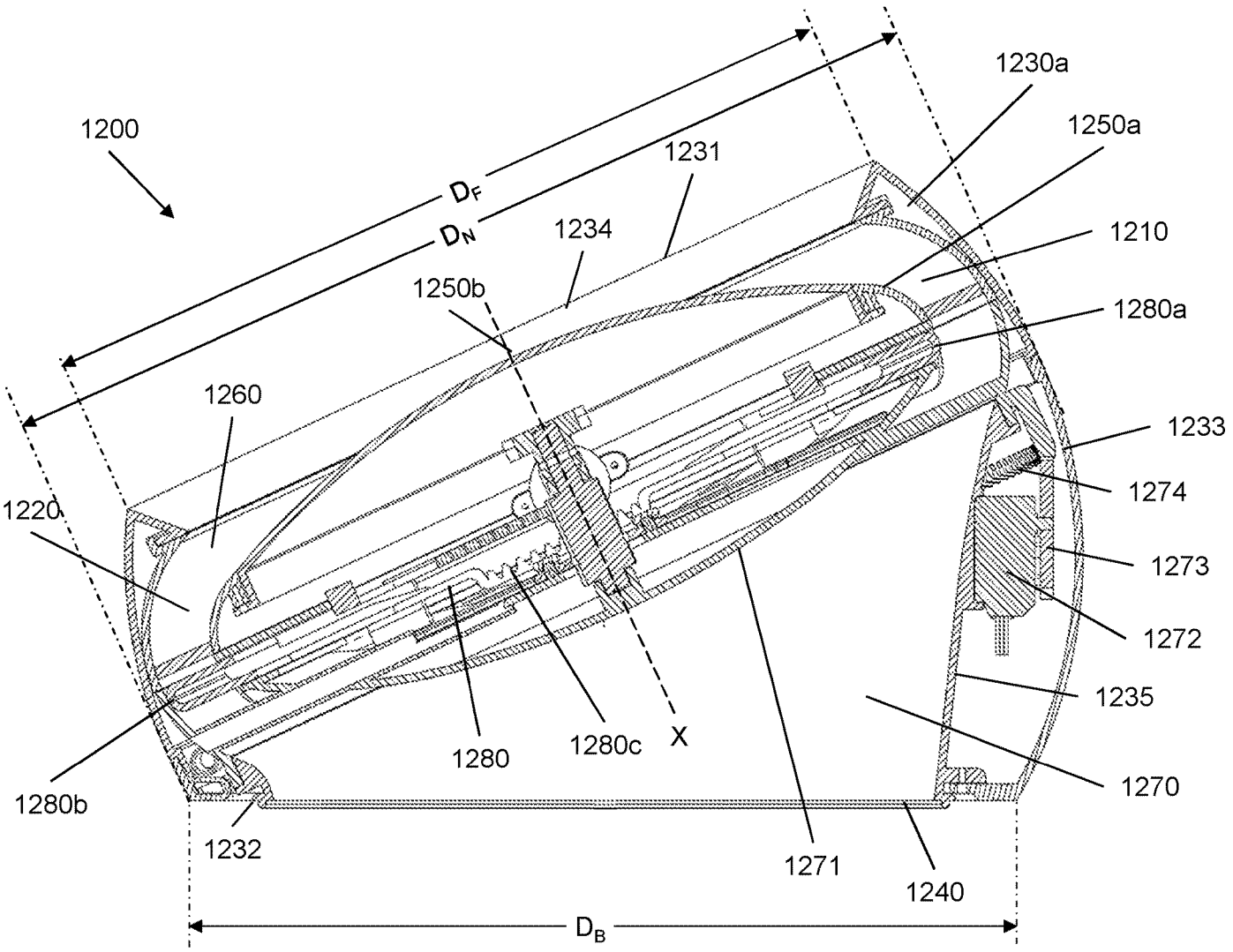
FIG. 7 is a vertical cross-sectional view of the spherical nozzle taken along line A-A of FIG. 6.
Figure 8:
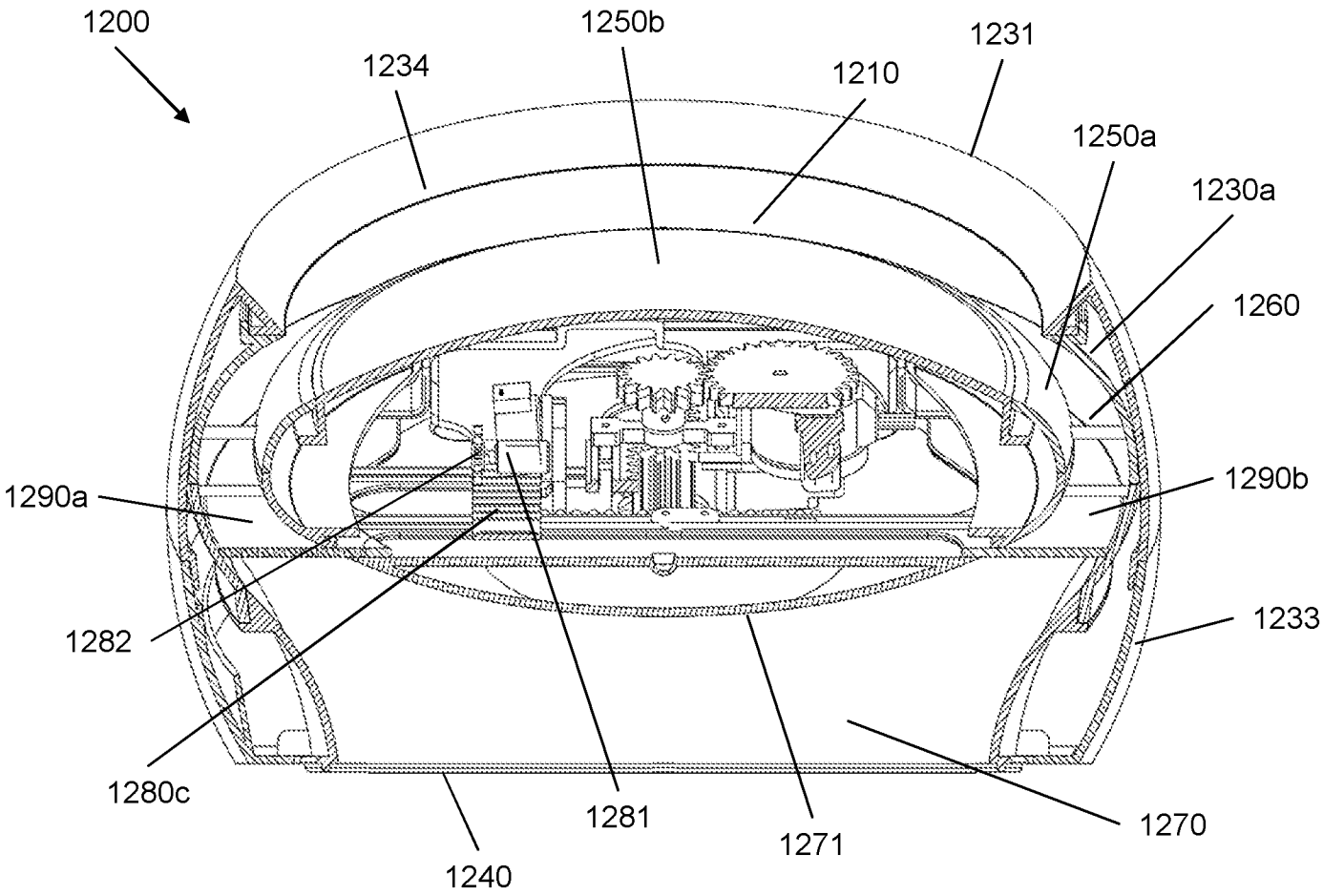
FIG. 8 is a vertical cross-sectional view of the spherical nozzle taken along line B-B of FIG. 10.
Figure 9:
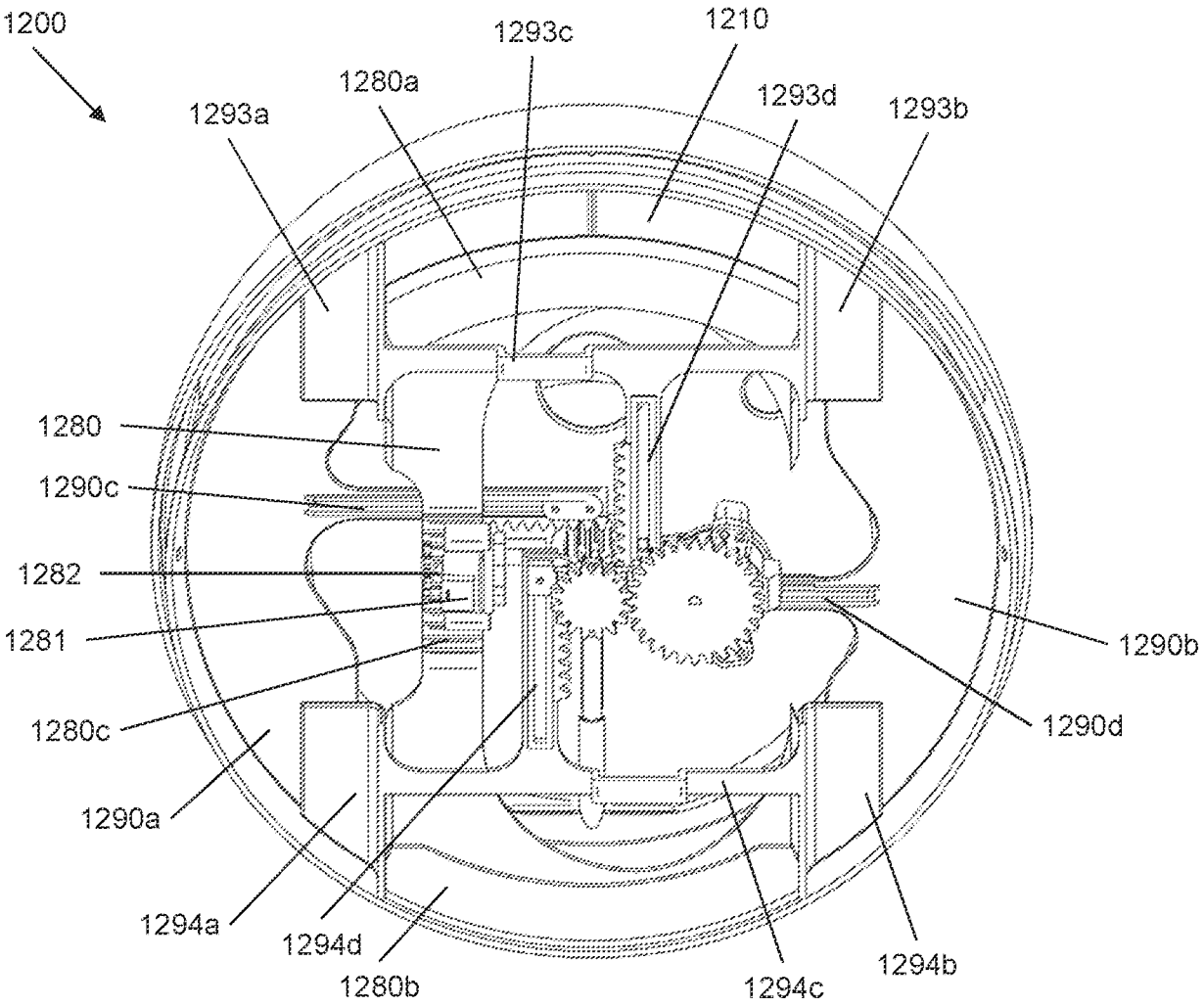
FIG. 9 is a top view of the spherical nozzle of FIG. 3 with an upper portion removed.
Figure 10:
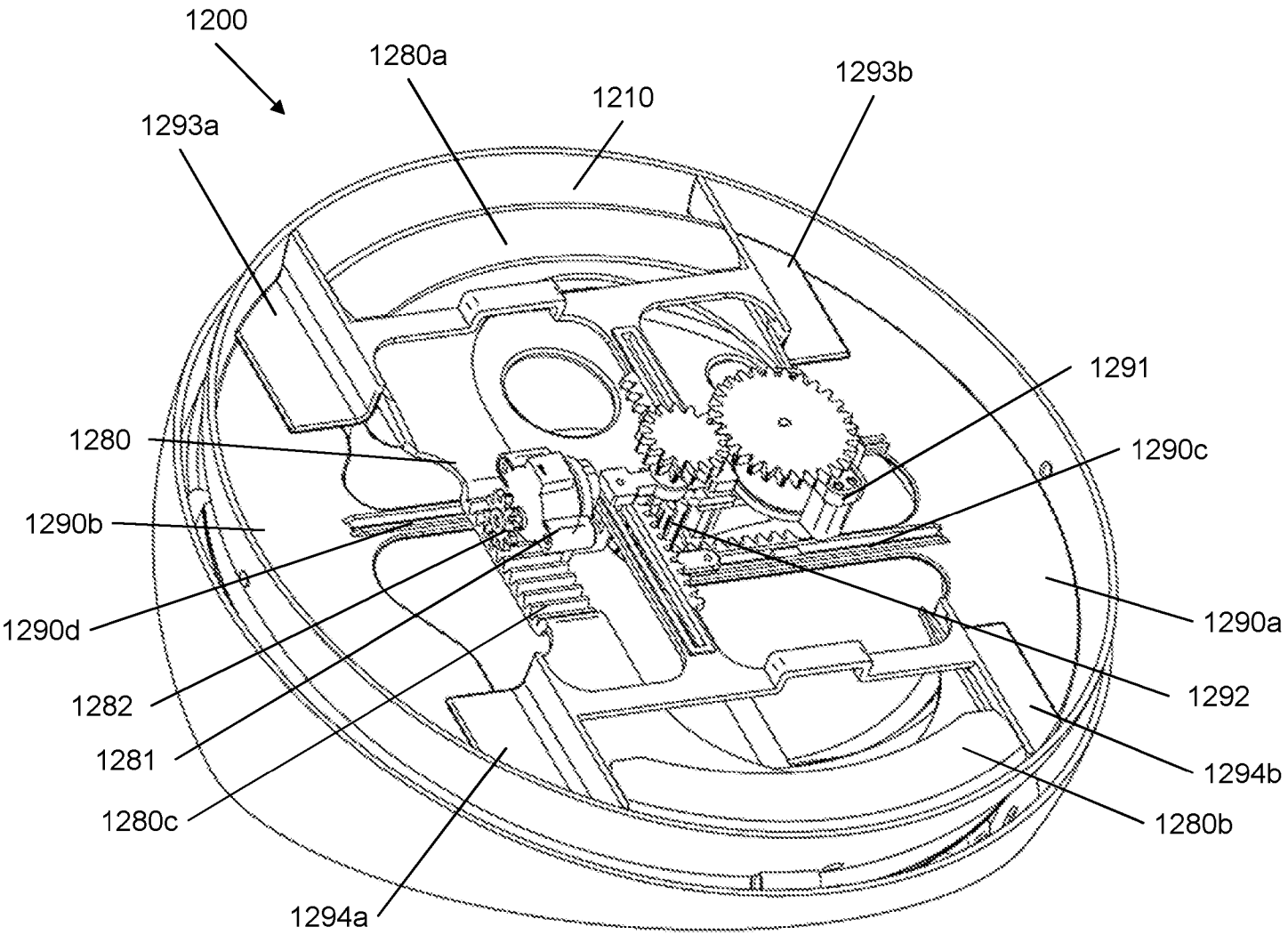
FIG. 10 is a perspective view of the spherical nozzle of FIG. 3 with an upper portion removed.

The construction and operation of the nozzle 1200 will be described in more detail below in relation to FIGS. 7 to 11*c*. FIG. 7 shows a sectional view through line A-A of FIG. 5, whilst FIG. 8 shows a sectional view through line B-B of FIG. 6. FIGS. 9 and 10 then show top and perspective views of the nozzle 1200 with the guide surface and an upper portion of the nozzle body removed.

As described above, the nozzle 1200 has the general shape of a truncated sphere, with a first truncation forming a circular face 1231 of the nozzle and a second truncation forming a circular base 1232 of the nozzle body 1230. The nozzle body 1230 therefore comprises an outer wall 1233 that defines the truncated spherical shape. The outer wall 1233 then defines a circular opening on the circular face 1231 of the nozzle 1200 and a circular opening on the circular base 1232 of the nozzle body 1230. The nozzle body 1230 also comprises a lip 1234 that extends inwardly from the edge of the outer wall 1233 that forms the first truncation. This lip 1234 is generally frustoconical in shape and tapers inwardly towards the guide surface 1250.

The nozzle body 1230 further comprises an inner wall 1235 that is disposed within the nozzle body 1230 and that defines the single internal air passageway 1270 of the nozzle 1200. The inner wall 1235 is entirely curved and has a generally circular cross-section, with the cross-sectional area of the inner wall 1235 in a plane that is parallel to either the face 1231 or base 1232 of the nozzle body 1230 varying between the air inlet 1240 and the gap 1260 that defines the one or more air outlets of the nozzle 1200. In particular, the inner wall 1235 widens or flares outwardly adjacent the air inlet 1240 and then narrows adjacent the air outlets. The inner wall 1235 therefore generally conforms to the shape of the nozzle body 1230.

The inner wall 1235 has a circular opening at its lower end that is located concentrically within the circular opening of the circular base 1232 of the nozzle 1200, with this lower circular opening of the inner wall 1235 providing the air inlet 1240 for receiving the airflow from the body 1100. The inner wall 1235 also has a circular opening at its upper end that is located concentrically within the circular opening of the circular face 1231 of the nozzle body 1230. An inwardly curved upper end of the inner wall 1235 then meets/abuts with the lip 1234 that tapers inwardly from the outer wall 1233 to define the circular opening of the circular face 1231 of the nozzle body 1230.

The guide surface 1250 is then located concentrically with the upper circular opening of the inner wall 1235, and offset relative to the upper circular opening of the inner wall 1235 along the central axis of the upper circular opening of the inner wall 1235, such that the gap 1260 is therefore defined by the space between the inner wall 1235 and an adjacent portion of guide surface 1250. The inwardly curved upper end of the inner wall 1235 then overlaps/overhangs the circumferential portion 1250*a* of the guide surface 1250 to ensure that the angle at which an air flow exits the nozzle 1200 through the annular gap 1260 is sufficiently shallow to optimise the resultant air flow generated by the nozzle 1200. In particular, the angle at which an air flow exits the nozzle 1200 through the annular gap 1260 will determine the distance of the convergent point along the central axis (X) of the guide surface 1250 and the angle at which air flows will collide at the convergent point. The tapering outer surface of the lip 1234 then minimises the impact of this overhang on the angular range through which the air flow can be varied.

In this embodiment, two separate valve mechanisms are then located beneath the guide surface 1250. The first of these valve mechanisms is a mode switching valve that is arranged to change the air delivery mode of the nozzle 1200 from a directed mode to a diffuse mode. The second of these valve mechanisms is then a flow vectoring valve that is arranged to control the direction of the air flow generated by the nozzle when in the directed mode. Both valve mechanisms will be described in more detail below.

The nozzle 1200 further comprises an internal air directing or diverting surface 1271 beneath both valve mechanisms, with the air directing surface 1271 being arranged to direct the airflow within the single air inlet passageway 1270 towards the annular gap 1260. In this embodiment, this air directing surface 1271 is convex and substantially disk-shaped, and is therefore similar in form to the guide surface 1250, and is aligned/concentric with the guide surface 1250. Both valve mechanisms are therefore housed within a space defined between the guide surface 1250 and the air directing surface 1271.

In the illustrated embodiment, the internal air passageway 1270 that extends between the air inlet 1240 and the annular gap 1260 forms a plenum chamber that functions to equalise the pressure of the air flow received from the body 1100 of the fan assembly 1000 for more even distribution to the annular gap 1260. The air directing surface 1271 therefore forms an upper surface of the plenum chamber defined by the internal air passageway 1270.

As described briefly above, the mode switching valve is arranged to change the air delivery mode of the nozzle 1200 from a directed mode to a diffuse mode. In the directed mode, the mode switching valve closes off all but two diametrically opposed, discrete (i.e. are physically separated from one another) portions of the gap 1260. These remaining open portions of the gap 1260 then form a pair of congruent, circular arc shaped slots that provide a first directed mode air outlet 1210 and a second directed mode air outlet 1220 of the nozzle 1200. As will be described in more detail below, the flow vectoring valve is then used to control the direction of the air flow emitted from the nozzle 1200 by just the first and second directed mode air outlets 1210, 1220.

When switching from directed mode to diffuse mode, the mode switching valve opens the closed portions of the gap 1260 (i.e. opens those portions of the gap 1260 that separate the pair of arcuate slots). In this diffuse mode, the entire gap 1260 can then become a single air outlet of the nozzle 1200 thereby providing a more diffuse, low pressure flow of air. In addition, the opening up of the entire gap 1260 by the mode switching valve provides that the air leaving the nozzle 1200 can be distributed around the entire periphery/circumference of the guide surface 1250 and all directed to the convergent point such that the resultant air flow generated by the nozzle 1200 will be directed substantially perpendicular relative to the face 1231 of the nozzle 1200. In this embodiment, the angle of the face 1231 of the nozzle 1200 relative to the base 1232 of the nozzle 1200, and therefore relative to the base of the fan assembly 1000, is such that when positioned on an approximately horizontal surface the resultant air flow generated by the fan assembly 1000 when the nozzle 1200 is in the diffuse mode will be directed in a generally upwards direction.

In the illustrated embodiment, the mode switching valve comprises a pair of mode switching valve members 1290*a*, 1290*b* mounted beneath the guide surface 1250 and above the air directing surface 1271. These mode switching valve members 1290*a*, 1290*b* are arranged to move laterally (i.e. translationally) relative to the guide surface 1250 between a closed position and an open position. In the closed position, the portions of the gap 1260 between the arcuate slots are occluded by the mode switching valve members 1290*a*, 1290*b*, whilst in the open position the portions of the gap 1260 between the arcuate slots are open. These mode switching valve members 1290*a*, 1290*b* can therefore be considered to be moveable covers for those portions of the annular gap 2260 that are between the arcuate slots.

In the illustrated embodiment, the mode switching valve members 1290*a*, 1290*b* are arranged such that in the closed position they each occlude the separate, diametrically opposed portions of the gap 1260 that are between one end of the first directed mode air outlet 1210 and an adjacent end of the second directed mode air outlet 1220. To do so, the mode switching valve members 1290*a*, 1290*b* are arranged such that in the closed position they each extend between opposing ends of the first air directed mode outlet 1210 and the adjacent end of the second directed mode air outlet 1220.

Each of the mode switching valve members 1290*a*, 1290*b* is substantially planar, with a distal edge of the valve member then being arcuate in shape so as to correspond with the shape of an opposing surface of the nozzle body 1230 that partially defines the gap 1260. In particular, the distal edge of each valve member has a radius of curvature that is substantially equal to a radius of curvature of the opposing surface of the nozzle body 1230. The distal edge of each of the mode switching valve members 1290*a*, 1290*b* can therefore abut against the opposing surface (i.e. the corresponding valve seat) when in the closed position in order to occlude a portion of the gap 1260 between the arcuate slots. In addition, the arcuate shape of the distal edge of each of the valve members 1290*a*, 1290*b* also provides that the distal edge will be substantially flush with an adjacent edge of the guide surface 1250 when in the open position. Each of the mode switching valve members 1290*a*, 1290*b* is then provided with a valve stem 1290*c*, 1290*d* that extends from the proximal edge of the valve member.

The mode switching valve further comprises a mode switching valve motor 1291 that is arranged to cause lateral (i.e. translational) movement of the mode switching valve members 1290*a*, 1290*b* relative to the guide surface 1250 in response to signals received from the main control circuit. To do so, the valve motor 1291 is arranged to cause rotation of a pinion 1292 that engages with linear racks provided on each of the valve stems 1290*c*, 1290*d*. Rotation of the pinion 1292 by the valve motor 1291 will therefore result in the linear movement of both valve members 1290*a*, 1290*b*. In this embodiment, rotation of the pinion 1292 by the valve motor 1291 is achieved using a set of gears, with a drive gear mounted on the shaft of the valve motor 1291 engaging a driven gear that is fixed to the pinion 1292, with the driven gear and the pinion 1292 thereby forming a compound gear.

In the embodiment illustrated in FIGS. 7 to 10, the mode switching valve further comprises two pairs of movable baffles 1293, 1294 that are arranged to assist with channelling the air emitted from the first and second directed mode air outlets 1210, 1220 respectively when the nozzle 1200 is in directed mode. In particular, the first pair of movable baffles 1293*a*, 1293*b* are arranged to assist with channelling the air emitted from the first directed mode air outlet 1210 when the nozzle 1200 is in directed mode, whilst the second pair of movable baffles 1294*a*, 1294*b* are arranged to assist with channelling the air emitted from the second directed mode air outlet 1220 when the nozzle 1200 is in directed mode. These two pairs of movable baffles 1293, 1294 are therefore arranged to be extended when the nozzle 1200 is in directed mode, and retracted when the nozzle 1200 is in diffuse mode so as to avoid the baffles from obstructing the gap 1260.

Each pair of movable baffles 1293, 1294 comprises a first moveable baffle 1293*a*, 1294*a* and a second moveable baffle 1293*b*, 1294*b*, with the first moveable baffle 1293*a*, 1294*a* and second moveable baffle 1293*b*, 1294*b* being provided at opposite ends of an elongate strut 1293*c*, 1294*c*. Each moveable baffle 1293*a*, 1293*b*, 1294*a*, 1294*b* has an approximately L-shaped cross section, with a first planar section extending downwardly from the end of the strut 1293*c*, 1294*c* to which the baffle is attached, and a second planar section then extending from the bottom end of the first planar section in a direction that is parallel with the length of the strut 1293*c*, 1294*c*. The first and second planar sections of each baffle then also extend in a direction that is perpendicular to the length of the strut 1293*c*, 1294*c*. The first planar section of each baffle then defines an end of one of the first and second directed mode air outlets 1210, 1220. A distal edge of the second planar section of each baffle is then arcuate in shape so as to correspond with the shape of an opposing surface of the nozzle body 1230 that partially defines the gap 1260. The distal edge of the second planar section of each baffle can therefore abut against an opposing surface when in the closed position. The second planar section of each baffle is then further arranged to overlap with a portion of the proximal edge of an adjacent mode switching valve member 1290*a*, 1290*b* so as to ensure that there is no route by which air can exit the nozzle 1200 between the baffle and the adjacent mode switching valve member 1290*a*, 1290*b*.

In this embodiment, these pairs of movable baffles 1293, 1294 are arranged to move laterally (i.e. translationally) relative to the guide surface 1250 between an extended position when the nozzle 1200 is in directed mode and a retracted position when the nozzle 1200 is in diffuse mode. To do so, each pair of movable baffles 1293, 1294 is provided with an actuator arm 1293*d*, 1294*d* that extends perpendicularly from the corresponding strut 1293*c*, 1294*c* at a position part-way between the ends of the strut 1293*c*, 1294*c*. These actuator arms 1293*d*, 1294*d* are each provided with a linear rack that engages with the pinion 1292 of the mode switching valve. Rotation of the pinion 1292 by the mode switching valve motor 1291 will therefore result in the linear movement of both pairs of movable baffles 1293, 1294. Consequently, when the mode switching valve is used to change the air delivery mode of nozzle 1200 between directed mode and diffuse mode, activation of the mode switching valve motor 1291 will cause rotation of the pinion 1292 that will in turn cause mode switching valve members 1290*a*, 1290*b* to move between a closed position and an open position, and will also simultaneously cause the pairs of movable baffles 1293, 1294 to move between an extended position and a retracted position.

In FIGS. 7 to 10 the nozzle 1200 is shown in directed mode, with the mode switching valve members 1290*a*, 1290*b* in the closed position and both pairs of movable baffles 1293, 1294 in the extended position. The portions of the gap 1260 that are between the first directed mode air outlet 1210 and the second directed mode air outlet 1220 are therefore occluded by the mode switching valve members 1290*a*, 1290*b*, with the first planar section of each pair of movable baffles 1293, 1294 then defining opposite ends of the first and second directed mode air outlets 1210, 1220 in order to assist in channelling the air over the guide surface 1500 and towards the convergent point.

In order to switch the nozzle 1200 to diffuse mode, the mode switching valve motor 1291 is activated so as to cause a rotation of the pinion 1292 that will in turn cause mode switching valve members 1290*a*, 1290*b* to move from the closed position to the open position. In the open position, the mode switching valve members 1290*a*, 1290*b* are retracted into the space defined between the guide surface 1250 and the air directing surface 1271 such that they no longer obstruct the portions of the gap 1260 that are between the first directed mode air outlet 1210 and the second directed mode air outlet 1220. Simultaneously, this rotation of the pinion 1292 will also cause the pairs of movable baffles 1293, 1294 to move from the extended position to the retracted position. In the retracted position, the pairs of movable baffles 1293, 1294 are retracted into the space defined between the guide surface 1250 and the air directing surface 1271 such that they no longer obstruct the portions of the gap 1260 that are between the first directed mode air outlet 1210 and the second directed mode air outlet 1220.

As described briefly above, the flow vectoring valve that is arranged to control the direction of the air flow generated by the nozzle when in the directed mode. To do so, the flow vectoring valve that is arranged to control the air flow from the air inlet to the first and second directed mode air outlets 1210, 1220 by adjusting the size (i.e. open area) of the first air directed mode outlet 1210 relative to the size (i.e. open area) of the second directed mode air outlet 1220 while keeping the size (i.e. open area) of the aggregate directed mode air outlet of the nozzle 1200 constant.

In the embodiment illustrated in FIGS. 7 to 10, the two diametrically opposed portions of the gap 1260 that remain open when the nozzle is in directed mode form a pair of congruent, circular arc shaped slots that provide the first and second directed mode air outlets 1210, 1220 of the nozzle 1200. The guide surface 1250 therefore provides an intermediate surface that extends between the first and second directed mode air outlets, with the overall air outlet of the nozzle 1200 being disposed around the periphery/perimeter of this intermediate surface.

In the illustrated embodiment, the pair of arcuate slots that provide the first and second directed mode air outlets 1210, 1220 each have an arc angle (β) (i.e. the angle subtended by the arc at the centre of the circular face 2231) of approximately 60 degrees; however, they could each have an arc angle of anything from 20 to 110 degrees, preferably from 45 to 90 degrees, and more preferably from 60 to 80 degrees. Consequently, the area of the gap 1260 can be anything from 3 to 18 times greater than the area of each of the first and second directed mode air outlets 1210, 1220, is preferably from 4 to 8 times greater, and is more preferably from 4 to 6 times greater.

The first and second directed mode air outlets 1210, 1220 are approximately the same size and together form an aggregate or combined directed mode air outlet of the spherical nozzle 1200. The first directed mode air outlet 1210 and the second directed mode air outlet 1220 are located on opposing sides of the guide surface 1250, and are orientated to direct an emitted air flow over a portion of the guide surface 1250 that is adjacent to the respective air outlet and towards a convergent point that is aligned with a central axis (X) of the guide surface 1250. The first directed mode air outlet 1210, the directed mode second air outlet 1220 and the guide surface 1250 are then arranged such that emitted air flows are directed over a portion of the guide surface 1250 that is adjacent to the respective directed mode air outlet. In particular, the directed mode air outlets 1210, 1220 are arranged to emit an air flow in a direction that is substantially parallel to the portion of the guide surface 1250 adjacent the air outlet 1210, 1220. The convex shape of the guide surface 1250 then provides that the air flows emitted from the first and second directed mode air outlets 1210, 1220 will depart from the guide surface 1250 as they approach the convergent point so that these air flows can collide at and/or around the convergent point without interference from the guide surface 1250. When the emitted air flows collide, a separation bubble is formed that can assist in stabilizing the resultant jet or combined air flow formed when two opposing air flows collide.

The flow vectoring valve then comprises a single valve member 1280 mounted beneath the guide surface 1250 and above the air directing surface 1271. The flow vectoring valve member 1280 is arranged to move laterally (i.e. translationally) relative to the guide surface 1250 between a first end position and a second end position. In the first end position the first directed mode air outlet 1210 is maximally occluded (i.e. occluded to the maximum extent possible, such that the size of the first directed mode air outlet is at a minimum) by the valve member 1280 and the second directed mode air outlet 1220 is maximally open (i.e. open to the maximum extent possible, such that the size of the second directed mode air outlet is at a maximum), whilst in the second end position the second directed mode air outlet 1220 is maximally occluded by the valve member 1280 and the first directed mode air outlet 1210 is maximally open. When the valve member 1280 moves between its two extreme positions the size/open area of the aggregate/combined directed mode air outlet remains constant.

When at a minimum the first and/or second directed mode air outlets 1210, 1220 may be fully occluded/closed. However, when at a minimum the first and/or second directed mode air outlets 1210, 1220 may be at least open to a very small extent as doing so can provide that any tolerances/inaccuracies arising during manufacture will not lead to small gaps that could induce additional noise (e.g. whistling) when air passes through.

In the illustrated embodiment, the valve member 1280 has a first end section 1280*a* that maximally occludes the first directed mode air outlet 1210 when the valve member 1280 is in the first end position, and an opposing second end section 1280*b* that maximally occludes the second directed mode air outlet 1220 when the valve member 1280 is in the second end position. The distal edges of the first and second end sections 1280*a*, 1280*b* of the valve member 1280 are both arcuate in shape so as to correspond with the shape of an opposing surface of the nozzle body 1230 that partially defines the corresponding directed mode air outlet. In particular, the distal edge of each valve member has a radius of curvature that is substantially equal to a radius of curvature of the opposing surface of the nozzle body 1230. The first end section 1280*a* of the valve member 1280 can therefore abut (i.e. touch or be adjacent/proximate to) an opposing surface when in the first end position in order to occlude the first directed mode air outlet 1210, with this opposing surface thereby providing a first valve seat, whilst the second end section 1280*b* of the valve member 1280 can abut (i.e. touch or be adjacent/proximate to) an opposing surface when in the second end position in order to occlude the second directed mode air outlet 1220, with this other opposing surface thereby providing a second valve seat. In addition, the arcuate shape of the distal edges of the first and second end sections 1280*a*, 1280*b* of the valve member 1280 also provide that the distal edge of the first end section 1280*a* will be substantially flush with an adjacent edge of the guide surface 1250 when in the second end position and that the distal edge of the second end section 1280*b* will be substantially flush with an adjacent edge of the guide surface 1250 when in in the first end position.

The flow vectoring valve further comprises a valve motor 1281 that is arranged to cause lateral (i.e. translational) movement of the valve member 1280 relative to the guide surface 1250 in response to signals received from the main control circuit. To do so, the valve motor 1281 is arranged to rotate a pinion 1282 that engages with a linear rack 1280*c* provided on the valve member 1280. In this embodiment, the linear rack 1280*c* is provided on an intermediate section of the valve member that extends between the first and second end sections 1280*a*, 1880*b*. Rotation of the pinion 1282 by the valve motor 1281 will therefore result in the linear movement of the valve member 1280. Linear movement of the valve member 1280 varies the size of the first directed mode air outlet 1210 relative to the size of the second directed mode air outlet 1220 while keeping the size of the aggregate directed mode air outlet of the nozzle 1200 constant. Preferably, when the nozzle 1200 switches from directed mode to diffuse mode, the flow vectoring valve motor 1281 is also activated so as to cause a rotation of the pinion 1282 that will in turn cause the flow vectoring valve member 1280 to move to a central position in which the first directed mode air outlet 1210 and the second directed mode air outlet 1220 are equal in size. In this configuration, the entire gap 1260 then becomes a single air outlet of the nozzle.

In the embodiment illustrated in FIGS. 7 to 10, the nozzle 1200 is also arranged so that the position of the pair of arcuate slots on the circular face of the nozzle 1200 can be varied. Specifically, the angular position of the pair of arcuate slots with respect to the central axis (X) of the guide surface 1250 is variable. The nozzle 1200 therefore further comprises an outlet rotation motor 1272 that is arranged to cause rotational movement of the pair of arcuate slots around the central axis (X) of the guide surface 1250. To do so, the outlet rotation motor 1272 is arranged to cause rotation of a pinion 1273 that engages with an arc-shaped rack 1274 that is connected to the air directing surface 1271. The air directing surface 1271 is then rotationally mounted within the nozzle body 1230, with the flow vectoring valve and mode switching valve mechanisms then being supported by the air directing surface 1271. Rotation of the pinion 1273 by the outlet rotation motor 1272 will therefore result in the rotational movement of the air directing surface 1271 within the nozzle body 1230 that will in turn cause rotation of both the flow vectoring valve and mode switching valve around the central axis (X) of the guide surface 1250. Given that the pair of arcuate slots that form the first and second directed mode air outlets 1210, 1220 are defined by those portions of the gap 1260 that are not occluded by the mode switching valve members 1290*a*, 1290*b*, rotation of the mode switching valve results in a change in the angular position of the pair of arcuate slots with respect to the central axis (X) of the guide surface 1250.

Figure 11A:
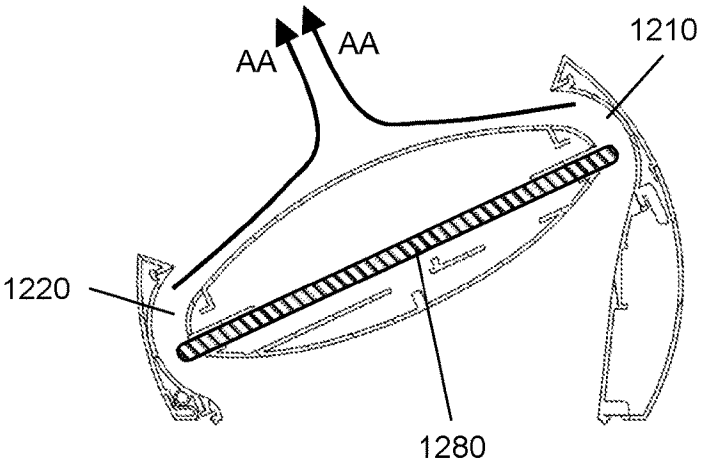
FIG. 11*a* is a simplified vertical cross-sectional view of the spherical nozzle illustrating a valve member in a first position.
Figure 11B:
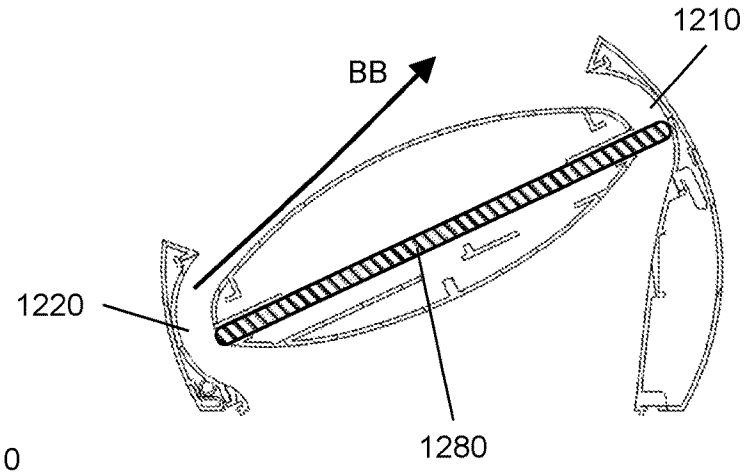
FIG. 11*b* is a simplified vertical cross-sectional view of the spherical nozzle illustrating a valve member in a second position.
Figure 11C:
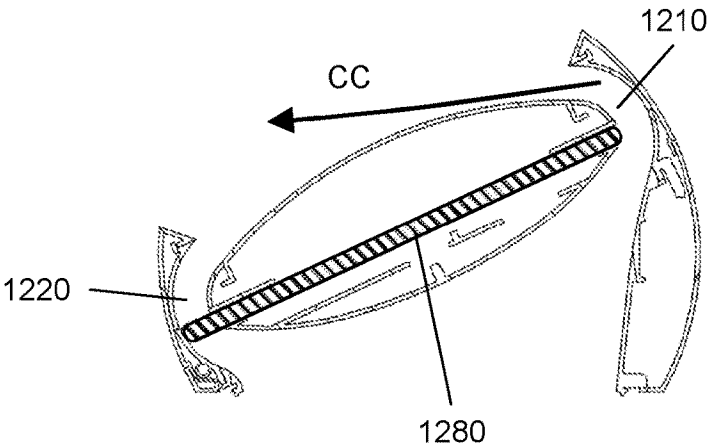
FIG. 11*c* is a simplified vertical cross-sectional view of the spherical nozzle illustrating a valve member in a third position.

Turning now to FIGS. 11*a* to 11*c*, these show three potential resultant air flows that can be achieved, when the nozzle 1200 is in directed mode, by varying the size of the first directed mode air outlet 1210 relative to the size of the second directed mode air outlet 1220 while keeping the size of the aggregate directed mode air outlet of the nozzle 1200 constant.

In FIG. 11*a*, the flow vectoring valve is arranged with the flow vectoring valve member 1280 in the central position in which the first directed mode air outlet 1210 and the second directed mode air outlet 1220 are equal in size such that an equal amount of air flow is emitted from the first directed mode air outlet 1210 and the second directed mode air outlet 1220. The first and second directed mode air outlets 1210, 1220 are oriented towards the convergent point that is aligned with the central axis (X) of the guide surface 1250. When the two air flows have the same strength, as will be the case in the FIG. 11*a*, the resultant air flow will be directed forwards from (i.e. substantially perpendicular relative to) the face 1231 of nozzle 1200, as indicated by arrows AA.

In FIG. 11*b*, the flow vectoring valve is arranged with the flow vectoring valve member 1280 in the first end position in which the first directed mode air outlet 1210 is maximally occluded and the second directed mode air outlet 1220 is maximally open. This means that most, if not all, of the air flow entering the nozzle 1200 will be emitted through the second directed mode air outlet 1220. The air flow will be directed to flow over the guide surface 1250 as normal, but since it will not collide with any significant air flow that is emitted from the first directed mode air outlet 1210 it will continue on its flow path, as indicated by arrows BB.

In FIG. 11*c*, the flow vectoring valve is arranged with the flow vectoring valve member 1280 in the second end position in which the second directed mode air outlet 1220 is maximally occluded and the first directed mode air outlet 1210 is maximally open. This means that most, if not all, of the air flow entering the nozzle 1200 will be emitted through the first directed mode air outlet 1210. The air flow will be directed to flow over the guide surface 1250 as normal, but since it will not collide with any significant air flow that is emitted from the second directed mode air outlet 1220 it will continue on its flow path, as indicated by arrows CC.

It will be readily understood that the examples of FIGS. 11*a*, 11*b* and 11*c* are merely representative, and actually represent some of the extreme cases. By utilising a control circuit to control the flow vectoring valve motor 1281 connected to the flow vectoring valve member 1280 it is possible to achieve a wide variety of resultant air flows. The direction of the resultant air flows can be further varied by controlling the outlet rotation motor 1272 to adjust the angular position of the first and second directed mode air outlets 1210, 1220.

As described above, the dual mode configuration of the nozzle is particularly useful when the nozzle is intended for use with a fan assembly that is configured to provide purified air as the user of such a fan assembly may wish to continue to receive purified air from the fan assembly without the cooling effect produced by the higher pressure, focused airflow provided in directed mode. Furthermore, in the preferred embodiments described above, the angle of the face of the nozzle relative to the base of the nozzle, and therefore relative to the base of the fan assembly, is such that when positioned on an approximately horizontal surface the resultant air flow generated by the fan assembly when the nozzle is in the diffuse mode will be directed in a generally upwards direction. These embodiments therefore also provide that the diffuse mode airflow is delivered to the user indirectly, thereby further decreasing the cooling effect produced by the airflow.

It will be appreciated that individual items described above may be used on their own or in combination with other items shown in the drawings or described in the description and that items mentioned in the same passage as each other or the same drawing as each other need not be used in combination with each other. In addition, the expression "means" may be replaced by actuator or system or device as may be desirable. In addition, any reference to "comprising" or "consisting" is not intended to be limiting in any way whatsoever and the reader should interpret the description and claims accordingly.

Furthermore, although the invention has been described in terms of preferred embodiments as set forth above, it should be understood that these embodiments are illustrative only. Those skilled in the art will be able to make modifications and alternatives in view of the disclosure which are contemplated as falling within the scope of the appended claims. For example, those skilled in the art will appreciate that the above-described invention might be equally applicable to other types of environmental control fan assemblies, and not just free standing fan assemblies. By way of example, such a fan assembly could be any of a freestanding fan assembly, a ceiling or wall mounted fan assembly and an in-vehicle fan assembly.

By way of further example, whilst in the above described embodiment the nozzle has the general shape of a truncated sphere, with both the face and the slot that defines the total/overall air outlet of the nozzle then being generally circular in shape, the nozzle and slot could have different shapes. For example, rather than having the general shape of a sphere, the nozzle of the above described embodiment could have the generally shape of a non-spherical ellipsoid or a non-spherical spheroid. In addition, rather than being circular, the face of the nozzle could have the shape of a non-circular ellipse. Similarly, rather than being circular, the slot defining the total air outlet of the nozzle could have the shape of a non-circular ellipse, with the first and second directed mode air outlets then each being non-circular, elliptical arcs.

Furthermore, whilst in the above described embodiment the nozzle has just a single air outlet in the form of the generally annular gap, the nozzle could equally comprise a plurality of air outlets. For example, the space between the intermediate guide surface and the nozzle body could be divided up into a plurality of separate arc-shaped slots, with each of these slots then forming a separate air outlet that together define the overall/total air outlet of the nozzle. In this case, the mode switching valve could be arranged such that, when in the directed mode, only a first subset of the plurality of air outlets would be occluded by the one or more valve members, whilst in the diffuse mode, the first subset of the plurality of air outlets would be at least partially open, and preferably maximally open. In both the directed and diffuse modes, a second subset of the plurality of air outlets would then be at least partially open (i.e. the valve would be arranged such that the valve members do not encroach/impinge upon the second subset of the plurality of air outlets), with this second subset then providing the directed mode air outlets of the nozzle.

Additionally, whilst in the above described embodiment the base of the nozzle body is mounted directly on to the upper end of the body of the fan assembly, in an alternative embodiment the nozzle may further comprise a neck that is provided at the base of the nozzle body and that is arranged to be connected to the upper end of the body of the fan assembly. The neck may then define the air inlet of the nozzle with the open lower end of the nozzle body then defining an air inlet of the nozzle body.

Moreover, whilst some of the above described embodiments make use of a valve motor for driving the movement of one or more valve members, all of the nozzles described herein could alternatively include a manual mechanism for driving the movement of the valve member(s), wherein the application of a force by the user would be translated into movement of the valve member(s). For example, this could take the form of a rotatable dial or wheel or a sliding dial or switch, with rotation or sliding of the dial by a user causing rotation of a pinion.

The invention claimed is:

1. A nozzle for a fan assembly, the nozzle comprising:

a nozzle body having the general shape of a truncated ellipsoid, with a first truncation defining a face of the nozzle body having a single opening defined by the face of the nozzle body and with a second truncation defining a base of the nozzle body;

an intermediate surface disposed within the opening such that there is an annular gap between the face of the nozzle body and the intermediate surface;

an air inlet for receiving an air flow, the air inlet being provided at the base of the nozzle body; and an air outlet for emitting the air flow, the air outlet being provided at the annular gap between the face of the nozzle body and the intermediate surface.

2. The nozzle of claim 1, and further comprising a single internal air passageway within the nozzle body that extends between the air inlet and the air outlet.

3. The nozzle of claim 2, wherein the air passageway is at least partially defined by an internal surface of the nozzle.

4. The nozzle of claim 2, wherein the cross-sectional area of the air passageway varies between the air inlet and the air outlet.

5. The nozzle of claim 2, wherein the air passageway widens adjacent the air inlet and narrows adjacent the air outlet.

6. The nozzle of claim 2, wherein the air passageway comprises a plenum region between the air inlet and the air outlet.

7. The nozzle of claim 6, wherein the plenum region is defined by an internal surface of the nozzle and a diverting surface disposed within the nozzle body, wherein the diverting surface is arranged to direct the airflow within the air passageway towards the air outlet.

8. The nozzle of claim 1, wherein an angle of the face of the nozzle body relative to the base of the nozzle body is fixed.

9. The nozzle of claim 8, wherein the angle of the face relative to the base is from 0 to 90 degrees.

10. The nozzle of claim 1, wherein the base of the nozzle body is arranged to be mounted over an air outlet of the fan assembly.

11. The nozzle of claim 1, wherein the intermediate surface spans an area between portions of the air outlet.

12. The nozzle of claim 1, wherein the intermediate surface defines a portion of each portion of the air outlet.

13. The nozzle of claim 12, wherein portions of the air outlet are each defined by a portion of the intermediate surface and an opposing portion of the nozzle body.

14. The nozzle of claim 13, wherein, for each portion of the air outlet, the portion of the intermediate surface that partially defines the portion of the air outlet has a shape that corresponds with a shape of the opposing portion of the nozzle body.

15. The nozzle of claim 1, wherein the air outlet is oriented to direct an air flow over at least a portion of the intermediate surface.

16. The nozzle of claim 1, wherein the nozzle defines a gap between the intermediate surface and the nozzle body, and wherein portions of the air outlet are provided by portions of the gap.

17. The nozzle of claim 1, wherein the air outlet comprises a curved slot that is provided on the face of the nozzle body.

18. The nozzle of claim 1, wherein nozzle comprises a first portion of the air outlet and a second portion of the air outlet.

19. The nozzle of claim 18, wherein the first and second portions of the air outlet comprise a pair of curved slots that are diametrically opposed on the face of the nozzle body.

20. The nozzle of claim 19, wherein the first and second portions of the air outlet comprise a pair of arcuate slots having an arc angle of from 20 to 110 degrees.

21. The nozzle of claim 19, wherein the nozzle defines an elliptical gap between the intermediate surface and the nozzle body, and wherein the first and second portions of the air outlet are provided by portions of the elliptical gap and wherein the pair of curved slots are provided by separate portions of the elliptical gap.

22. The nozzle of claim 21, wherein the portions of the gap between the pair of curved slots are each occluded by one or more covers.

23. The nozzle of claim 18, and further comprising a valve for controlling an air flow from the air inlet to the air outlet.

24. The nozzle of claim 23, wherein the first and second portions of the air outlet together define a combined air outlet, and the valve comprises one or more valve members which are moveable to adjust the size of the first portion of the air outlet relative to the size of the second portion of the air outlet while keeping the size of the combined air outlet constant.

25. The nozzle of claim 1, wherein the nozzle body has the general shape of a truncated sphere, with a first truncation forming a circular face of the nozzle body and a second truncation forming at least part of a circular base of the nozzle body.

26. A fan assembly comprising an impeller, a motor for rotating the impeller to generate an air flow, and the nozzle of claim 1 for receiving the air flow.

* * * * *